United States Patent [19]

Richards et al.

[11] 4,307,997

[45] Dec. 29, 1981

[54] FREE PISTON INERTIA COMPRESSOR

[75] Inventors: William D. C. Richards, King of Prussia; Denis Bilodeau, Phoenixville, both of Pa.; Thomas Marusak, Loudenville, N.Y.; Leonard Dutram, Jr., Trappe; Joseph Brady, Telford, both of Pa.

[73] Assignee: The United States of America as represented by the United States Department of Energy, Washington, D.C.

[21] Appl. No.: 37,079

[22] Filed: May 8, 1979

[51] Int. Cl.[3] ..... F04B 31/00

[52] U.S. Cl. ..... 417/211; 417/469; 92/10

[58] Field of Search ..... 417/241, 211, 469, 460; 92/10, 85 B, 151

[56] References Cited

U.S. PATENT DOCUMENTS

| | | | |
|---|---|---|---|
| 740,892 | 10/1903 | Meyer | 417/393 |
| 823,431 | 6/1906 | McManus | 417/211 X |
| 1,513,550 | 10/1924 | Hawkins | 417/393 |
| 2,648,489 | 8/1953 | Dyer | 417/211 |
| 2,698,605 | 1/1955 | Kress | 92/151 |
| 3,267,815 | 8/1966 | Ortman et al. | 92/85 B |
| 3,461,806 | 8/1969 | Barthalon | 92/10 |
| 3,805,672 | 4/1974 | Pekrul | 92/85 B |

FOREIGN PATENT DOCUMENTS

| | | | |
|---|---|---|---|
| 725592 | 5/1932 | France | 417/211 |

*Primary Examiner*—Leonard E. Smith

*Attorney, Agent, or Firm*—Paul A. Gottlieb; Frank H. Jackson; James E. Denny

[57] ABSTRACT

A free piston inertia compressor comprises a piston assembly including a connecting rod having pistons on both ends, the cylinder being split into two substantially identical portions by a seal through which the connecting rod passes. Vents in the cylinder wall are provided near the seal to permit gas to excape the cylinder until the piston covers the vent whereupon the remaining gas in the cylinder functions as a gas spring and cushions the piston against impact on the seal. The connecting rod has a central portion of relatively small diameter providing free play of the connecting rod through the seal and end portions of relatively large diameter providing a limited tolerance between the connecting rod and the seal. Finally, the seal comprises a seal ring assembly consisting of a dampener plate, a free floating seal at the center of the dampener plate and a seal retainer plate in one face of the dampener plate.

6 Claims, 5 Drawing Figures

FREE PISTON INERTIA COMPRESSOR

CONTRACTUAL ORIGIN OF THE INVENTION

The invention described herein was made in the course of, or under, a contract with the UNITED STATES DEPARTMENT OF ENERGY.

BACKGROUND OF THE INVENTION

This invention relates to a compressor. In more detail the invention relates to a free piston inertia compressor. Specifically the invention relates to a free piston inertia compressor which is useful in combination with a free piston Stirling engine as a refrigerant compressor in a gas fired heat pump. The invention also relates to a seal ring assembly for use therein.

Inertia or free piston pumps and compressors are old in the art, typical examples being shown in U.S. Pat. No. 3,198,425 granted Aug. 3, 1965, and the patents cited therein. By employing a free piston compressor, a compressor can be attached directly to the reciprocating motion of any device such as a power piston and the connecting rod/crank-shaft/bearing and seal system that would be required to connect the linear motion of a piston to the rotary motion of a conventional rotary compressor is not needed.

Thus free piston inertia compressors are particularly suited for use in combination with a free piston Stirling engine in a gas fired heat pump. In the gas fired heat pump, a free piston Stirling engine is the prime mover and this engine provides linear motion to drive directly the free piston vapor compressor for the refrigeration cycle. Incorporation of an inertia compressor with a free piston Stirling engine permits complete isolation of the Stirling engine working fluid from the ambient and from the refrigeration loop without the use of dynamic seals.

SUMMARY OF THE INVENTION

A free piston inertia compressor comprises a piston assembly including a connecting rod having pistons on both ends, the cylinder being split into two substantially identical portions by a seal through which the connecting rod passes. Vents in the cylinder wall are provided near the seal to permit gas to escape the cylinder until the piston covers the vent whereupon the remaining gas in the cylinder cushions the piston against impact on the seal. The connecting rod has a central portion of relatively small diameter providing free play of the connecting rod through the seal and end portions of relatively large diameter providing a limited tolerance between the connecting rod and the seal. Finally, the seal comprises a seal ring assembly consisting of a dampener plate, a free floating seal at the center of the dampener plate and a seal retainer plate in one face of the dampener plate.

DETAILED DESCRIPTION OF THE PREFERRED EMBODIMENT

Figure 1:
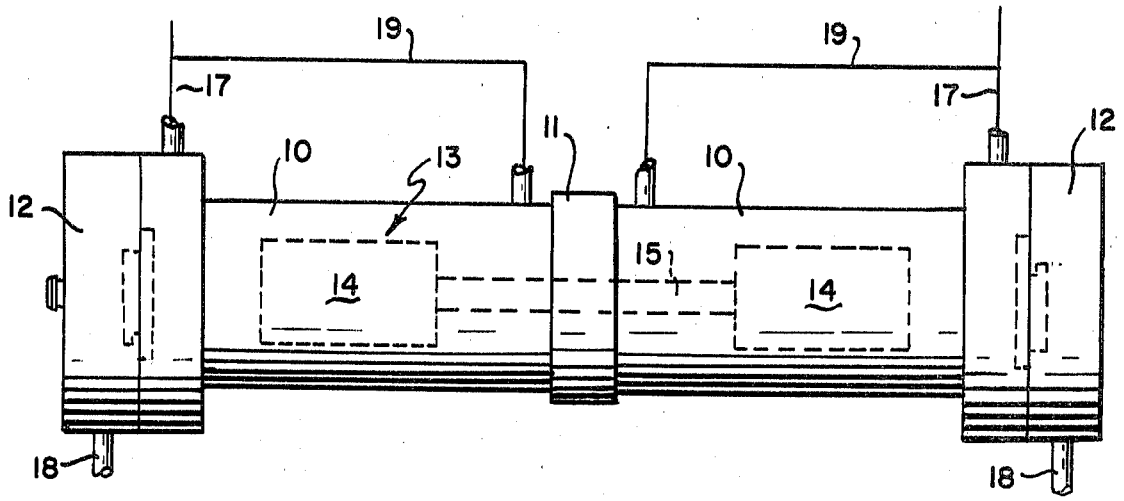
FIG. 1 is a schematic side view of a free piston inertia compressor according to the present invention.
Figure 4:
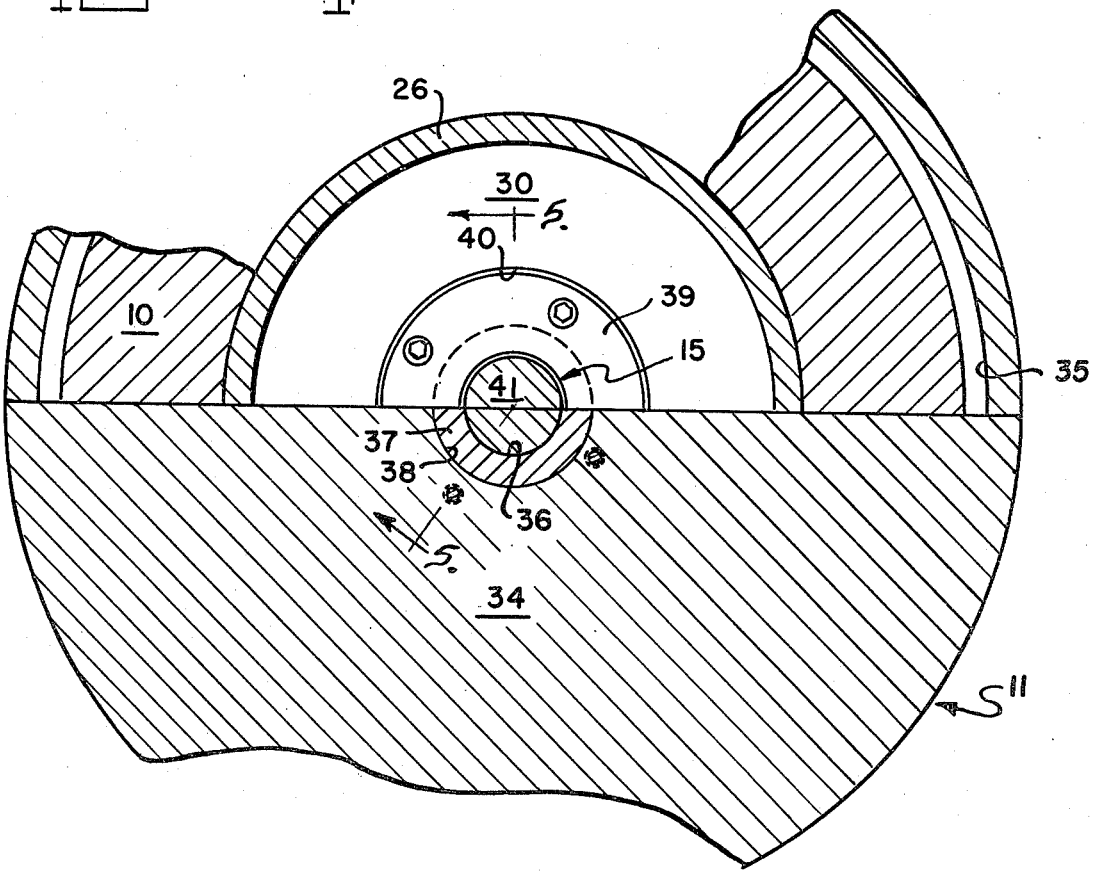
FIG. 4 is a transverse section taken in the direction of the arrows 4—4 in FIG. 2.
Figure 2:
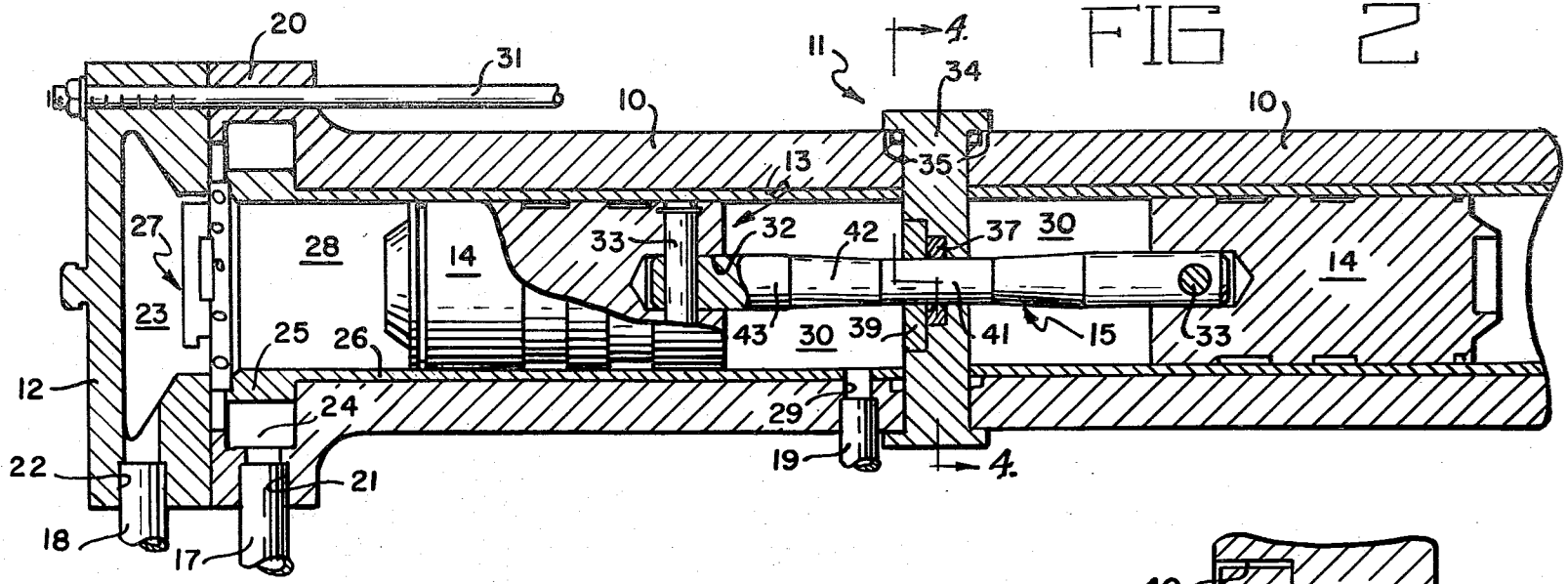
FIG. 2 is a longitudinal section through the major portion thereof.
Figure 5:
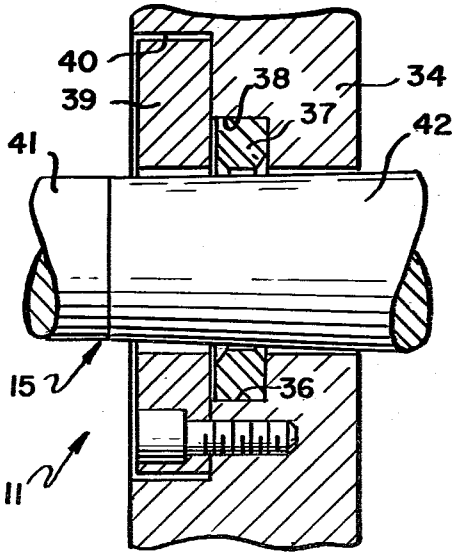
FIG. 5 is a section taken in the direction of the arrows 5—5 in FIG. 4.
Figure 3:
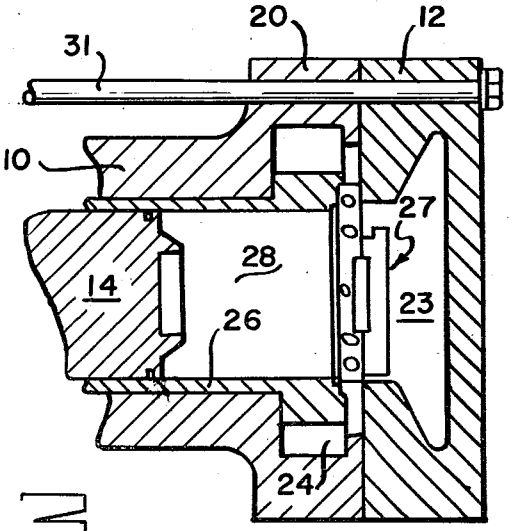
FIG. 3 is a longitudinal section through the remainder of the compressor.

Referring first to FIG. 1 the compressor comprises a cylinder 10 which is split at its midpoint with a seal ring assembly 11 being interposed between the two halves thereof. The cylinder 10 is provided with end caps 12 at both ends thereof and a double-acting piston assembly 13 is provided for reciprocation in the housing. Piston assembly 13 includes identical pistons 14 disposed at opposite ends of a connecting rod 15. The compressor is operated by shaking cylinder 10 axially as by a free piston Stirling engine (not shown) attached to one end thereof. Suction lines 17 provide low pressure refrigerant to the cylinder and discharge lines 18 conduct high pressure refrigerant away from the cylinder. Vent lines 19 are provided for a purpose to be described hereinafter.

The invention will now be described in detail with reference to FIGS. 2 to 5 of the drawing. Since the compressor is essentially symmetrical about the seal ring assembly only one side of the compressor will be described. As shown, a flange 20 at the end of cylinder 10 has an inlet port 21 drilled radially therein and end cap 12 has an outlet port 22 drilled radially therein. Suction line 17 communicates with inlet port 21 and discharge line 18 communicates with outlet port 22. End cap 12 has a cavity 23 therein constituting an outlet manifold for the discharge of refrigerant and flange 20 of cylinder 10 has a rectangular groove 24 in the interior face thereof which is closed by a flange 25 on the end of a liner 26 for the cylinder 10 to constitute an annular inlet manifold for the introduction of refrigerant into the cylinder. Both inlet manifold 24 and outlet manifold 23 communicate with a suction/discharge valve assembly 27 which is not shown in detail as it forms no part of the present invention. Valve assembly 27 allows admission of refrigerant to the cylinder during the suction stroke while sealing the discharge line and allows discharge of refrigerant during and subsequent to the compression stroke while sealing the suction line. Such valves are commercially available and any valve which functions as described can be employed. Valve assembly 27 communicates with compression chamber 28 in cylinder 10. It will be noted that in the specific design shown herein, the suction/discharge end of the compressor was designed to accept a particular available valve assembly. Use of other valve assemblies might require some redesign at the ends of the compressor.

A vent port 29 is drilled radially in cylinder 10 a short distance from sealing assembly 11 placing vent line 19 in communication with gas spring chamber 30 in cylinder 10. As piston 14 approaches seal ring assembly 11, the refrigerant present in gas spring chamber 30 is vented through vent line 19 and suction line 17 to suction manifold 24. When piston 14 covers vent port 29, venting no longer occurs and the refrigerant gas present in gas spring chamber 30 compresses serving as a gas spring to initiate movement in the opposite direction and further, cushioning the piston against impact against seal ring assembly 11.

Valve assembly 27 is clamped between flange 25 of liner 26 and end cap 12. Tie rods 31 clamp the several sections of the compressor together between end caps 12. To provide for possible misalignment between the two halves of cylinder 10, connecting rod 15 is pinned into sockets 32 in pistons 14 by pins 33 which are perpendicular to each other.

Seal ring assembly 11 cooperates with connecting rod 15 to seal the two gas spring chambers 30 one from the other during a portion of the piston assembly 13 reciprocating movement. The specific structure of seal ring assembly 11 and connecting rod 15 which accomplishes this constitutes an important feature of the present invention which will next be described in considerable detail.

Seal ring assembly 11 comprises a cylindrical dampener plate 34 of slightly greater diameter than cylinder 10. The two parts of cylinder 10 are sealed into recesses 35 on opposite sides of dampener plate 34. Dampener plate 34 has an axial opening 36 therein which accepts connecting rod 15 of piston assembly 13. One face of dampener plate 34 has stepped recesses therein, seal ring 37 floating in recess 38 at the center of dampener plate 34, and seal retainer plate 39 being fastened in shallow recess 40 to hold seal ring 37 in place. Seal ring 37 is essentially square in cross section with the inner corners thereof being chamfered and all sharp edges being broken to 0.005 R maximum.

Connecting rod 15 has a relatively small diameter central portion 41, transition portions 42 of expanding cross section and end portions 43 of relatively large diameter. End portions 43 have a diameter slightly less than the diameter of the opening in seal ring 37. Specifically, according to one embodiment of the invention, central portion 41 of connecting rod 15 has a diameter of 0.618–0.619 inch, end portions 43 have a diameter of 0.6248–0.6250 inch and the opening in ring 37 has a diameter of 0.6254–0.6256. Conveniently seal ring 37 is made of cast iron.

It will thus be seen that movement of the piston assembly 13 in the central portion of its stroke is not hindered by the seal ring. At both ends of the stroke, however, the tolerance between seal ring and connecting rod is less than one mil. Thus passage of fluid from one gas spring chamber 30 to the other is seriously impeded at the ends of the stroke where it is required that assembly 11 function as a seal. On the other hand, while the reduced diameter central portion 41 is in seal ring 37, gas including entrained oil can freely vent from one gas spring chamber 30 to the other and be expelled through the associated vent line 19. Thus the gas spring effect previously referred to is preserved. It will also be noted that the seal is self-aligning since the seal ring 36 is floating in seal ring assembly 11 and the inner corners thereof are chamfered and slightly rounded.

The embodiments of the invention in which an exclusive property or privilege is claimed are defined as follows:

1. In a free-piston inertia compressor comprising a cylinder and a free-floating piston assembly disposed for reciprocation therein, the improvement wherein said piston assembly includes a smoothly tapered connecting rod having pistons on both ends of the rod, wherein the connecting rod has end portions of relatively large diameter, which smoothly taper to a central portion of relatively small diameter, the central portion providing free play of the connecting rod through a single fixed seal at the longitudinal center of the cylinder for effecting a seal alternatively to the large diameter end portions of the rod and allowing the venting of fluid from one side of the seal to the other and the end portions providing tolerance of less than 1 mil between the relatively large diameter portions of the connecting rod and said seal to the large diameter portions preventing the passage of fluids; wherein the seal is constituted by a seal assembly having a cylindrical dampener plate of greater diameter than the cylinder, said dampener plate having recesses therein into which are sealed the two halves of the cylinder, said dampener plate having an axial opening therein which accepts the connecting rod, one face of the dampener plate having a deep recess therein located at the center of the dampener plate, a floating seal ring disposed in said deep recess, the same face of the dampener plate having a shallow recess therein and a seal retainer plate fastened in said shallow recess.

2. Improvement of claim 1 wherein said seal ring is approximately square in cross section with the inner edges thereof being chamfered and rounded off.

3. A multiple action free-piston inertia compressor comprising a cylinder capable of axial reciprocation by external means, said cylinder being split at its midpoint, a single fixed seal interposed between the two halves of the cylinder, a free-floating piston assembly consisting of a tapered connecting rod having pistons on both ends thereof disposed in the cylinder, each half of the cylinder being divided by its piston into a compression chamber and a gas spring chamber, the tapered connecting rod having end portions of relatively large diameter smoothly tapered to a relatively small diameter central portion, the central portion allowing free play of the connecting rod through the single fixed seal and the end portions of the connecting rods passing through the single fixed seal with a slip-fit engagement and means for introducing low-pressure fluid to the compression chambers prior to compression and for removing high pressure fluid from the compression chambers of the cylinder after compression; wherein the connecting rod is connected to the two pistons by connecting pins which are perpendicular to one another to provide for possible misalignment between the two halves of the cylinder.

4. Compressor according to claim 3 wherein the seal ring assembly comprises a cylindrical dampener plate having recesses on both sides thereof into which recesses the two halves of the cylinder are sealed, said dampener plate having an axial opening therein which accepts the connecting rod of the piston assembly.

5. Compressor according to claim 4 wherein the connecting rod has a central portion of relatively small diameter smoothly tapered to end portions of relatively large diameter, the tolerance between the seal ring and the end portions of the connecting rod being less than one mil.

6. Compressor according to claim 4 wherein the connecting rod has a central portion of relatively small diameter and end portions of relatively large diameter, the tolerance between the seal ring and the end portions of the connecting rod being small enough to provide a seal against the passage of fluids while the tolerance between the seal ring and the central portion of the connecting rod being great enough to permit the passage of fluids.

* * * * *